US006185894B1

(12) United States Patent
Sisco et al.

(10) Patent No.: US 6,185,894 B1
(45) Date of Patent: Feb. 13, 2001

(54) WOOD DOORS AND METHODS FOR FABRICATING WOOD DOORS

(75) Inventors: John R. Sisco, Olympia; Danny Clarence Holcomb, McCleary; R. Anthony Reynolds, Briar; Robert H. Forster, Seattle, all of WA (US)

(73) Assignee: Simpson Door Company, Seattle, WA (US)

( * ) Notice: Under 35 U.S.C. 154(b), the term of this patent shall be extended for 0 days.

(21) Appl. No.: 09/231,934

(22) Filed: Jan. 14, 1999

(51) Int. Cl.[7] ..... E06B 3/72

(52) U.S. Cl. ..... 52/457; 52/455; 52/585.1; 52/592.1; 52/796.1

(58) Field of Search ..... 52/457, 455, 585.1, 52/592.1, 796.1

(56) References Cited

U.S. PATENT DOCUMENTS

| | | | | |
|---|---|---|---|---|
| 1,559,983 | * | 11/1925 | Pfeiffer | 52/455 X |
| 2,334,113 | * | 11/1943 | Malarkey | 52/455 |
| 2,821,497 | | 1/1958 | Works et al. . | |
| 2,822,870 | * | 2/1958 | Haynes | 52/455 X |
| 2,825,099 | * | 3/1958 | Simmons | 52/455 |
| 3,004,641 | * | 10/1961 | Johnson | 52/455 |
| 3,878,647 | | 4/1975 | Burgers . | |
| 4,007,569 | | 2/1977 | Hascall . | |
| 4,068,431 | | 1/1978 | Pitt . | |
| 4,386,482 | | 6/1983 | Quinif . | |
| 4,429,498 | | 2/1984 | Pitt . | |
| 4,640,053 | | 2/1987 | Lew . | |
| 4,752,517 | | 6/1988 | Beitel . | |
| 5,074,087 | * | 12/1991 | Green | 52/455 X |
| 5,219,634 | | 6/1993 | Aufderhaar . | |
| 5,361,552 | | 11/1994 | Fulford . | |
| 5,584,154 | * | 12/1996 | Koepke et al. | 52/455 X |
| 5,661,943 | | 9/1997 | Hagel | 52/656.4 |
| 5,775,041 | * | 7/1998 | Tull et al. | 52/457 X |
| 5,829,218 | * | 11/1998 | Murray et al. | 52/455 |
| 5,873,209 | | 2/1999 | Hagel | 52/656.4 |

OTHER PUBLICATIONS

Schut, Jan H., "For Compounding, Sheet & Profile Wood is Good," www.plastictechnology.com, pp. 46–52, Mar. 1999.

Hacker et al., "Analysis of the Wood/Plastic Composites Industry and Wisconsin Wood Residue and Recyled Plastics Market," *Northwest Regional Planning Commission*, Dec. 1996.

Advertisement, FrameSaver™ with Guaranteed TimberTech™ End, Circle 18 on Reader Service Card, Fenestration, Jan./Feb. 1998.

* cited by examiner

*Primary Examiner*—Carl D. Friedman
*Assistant Examiner*—Phi Dieu Tran A
(74) *Attorney, Agent, or Firm*—Seed Intellectual Property Law Group PLLC

(57) ABSTRACT

A door includes a first wood stile and a second wood stile. The door can also include a top rail and a bottom rail. The top rail has a first end attached to the first upper region of the first stile and a second end attached to the second upper region of the second stile. The bottom rail similarly has a first end attached to the first lower region of the first stile and a second end attached to the second lower region of the second stile. The door also includes at least a first moisture-resistant end-cap attached to the first lower end of the first stile and/or the second lower end of the second stile. The first end-cap, for example, can be a single component extending across the lower ends of the stiles and a bottom surface of the bottom rail. The door more preferably includes a first moisture-resistant end-cap attached to the first lower end of the first stile and a separate second moisture-resistant end-cap attached to the second lower end of the second stile. The first end-cap can cover only the first lower end of the first stile, and the second end-cap can cover only the second lower end of the second stile. The first and second end-caps can accordingly be elements of a moisture-resistant end-cap assembly that inhibits moisture from entering the lower ends of the first and second stiles to prevent moisture from flowing through longitudinal vesicles in the first and second stiles.

17 Claims, 8 Drawing Sheets

WOOD DOORS AND METHODS FOR FABRICATING WOOD DOORS

TECHNICAL FIELD

The present invention relates to doors and methods for fabricating doors, such as exterior wood doors.

BACKGROUND OF THE INVENTION

Exterior doors are often used as an architectural feature in a home, business, or other building. In many applications, architects request wood exterior doors to impart a high quality, sophisticated appearance to a structure. Wood doors, for example, can be stained to use the natural wood grain in the exterior design of a structure.

Exterior wood doors typically have left and right wood stiles, top and bottom wood rails extending between the stiles, and a window or panel in the interior region between the stiles and the rails. The wood grain of the stiles typically extends vertically, and the wood grain of the rails typically extends horizontally. The ends of the stiles and rails are accordingly cross-cut transversely with respect to longitudinal vesicles of the wood grain. The open-grain ends of the stiles are thus exposed at the top and bottom of the door, and the open-grain ends of the rails are attached to the inner sides of the stiles. The rails are conventionally attached to the stiles with a plurality of dowels and a single layer of uncured adhesive (e.g., polyvinyl acetate) in the joint between the stiles and the open-grain ends of the rails. The rails and stiles can also have a core of one type of wood, and a veneer of a different type of wood.

Although exterior wood doors are often architecturally desirable, these doors have generally lost market share in recent years to metal and fiberglass doors because exterior wood doors can experience moisture damage if they are not properly treated before installation and not properly maintained afterward. In wet or humid environments, for example, exterior wood doors often absorb moisture in the bottom rail and the lower ends of the stiles absent proper protective coating and sealing. Moisture damage to inadequately sealed/coated exterior wood doors is particularly problematic with structures that do not have a sufficient overhang to protect the doors from rainwater. The moisture cannot readily escape from the rails and stiles, and thus rotting can occur in the lower and upper ends of a door. The moisture in the wood can also warp the rails and the stiles such that the doors may not properly fit in a door frame. Therefore, there is a demand for a moisture-resistant exterior wood door that can withstand wet and/or humid environments for a significant period of time.

SUMMARY OF THE INVENTION

The present invention relates to improved wood doors and fabrication methods. In one embodiment, a door includes a first wood stile and a second wood stile. The first wood stile includes a first upper region having a first upper end and a first lower region having a first lower end, and the second wood stile includes a second upper region having a second upper end and a second lower region having a second lower end. The door can also include a top rail and a bottom rail. The top rail has a first end attached to the first upper region of the first stile and a second end attached to the second upper region of the second stile. The bottom rail similarly has a first end attached to the first lower region of the first stile and a second end attached to the second lower region of the second stile.

The door also includes at least a first moisture-resistant end-cap attached to the first lower end of the first stile and/or the second lower end of the second stile. The first end-cap, for example, can be a single component extending across the lower ends of the stiles and a bottom surface of the bottom rail. The door more preferably includes a first moisture-resistant end-cap attached to the first lower end of the first stile and a separate second moisture-resistant end-cap attached to the second lower end of the second stile. The first end-cap can cover only the first lower end of the first stile, and the second end-cap can cover only the second lower end of the second stile. The first and second end-caps can accordingly be elements of a moisture-resistant end-cap assembly that inhibits moisture from entering the lower ends of the first and second stiles to prevent moisture from flowing through longitudinal vesicles in the first and second stiles.

In one embodiment, the first and second end-caps are extruded blocks of a composite including wood particles and a polymeric material. The first and second end-caps can also be other polymeric materials or other suitable moisture-resistant materials, with or without wood. The first and second end-caps, for example, can be blocks having lengths of approximately 1.0–3.0 inches. The bottom surfaces of the first and second end-caps are preferably flush with the bottom surface of the bottom rail. The end-caps limit absorption of moisture so that the bottom edge of a door can be exposed to water without absorbing and transporting water through the longitudinal vesicles of the first and second wood stiles.

In another embodiment, the door can also include a sealant layer over the open-grain ends of the bottom rail. For example, the sealant layer can be a layer of cured polyvinyl acetate covering the open-grained ends of the bottom rail. The bottom rail can then be attached to the interior surfaces of the first and second stiles using a separate layer of uncured adhesive in addition to the cured sealant layer. In still another embodiment, a veneer may be attached to a front side and a back side of each of the first stile, the second stile, and the first and second end-caps.

DETAILED DESCRIPTION OF THE INVENTION

The following description is generally directed toward exterior wood doors and methods for fabricating exterior wood doors. Many specific details of certain embodiments of the invention are set forth in the following description and in FIGS. 1–10 to provide a thorough understanding of such embodiments. One skilled in the art, however, will understand that the invention may have additional embodiments, or that the invention may be practiced without several of the details described in the following description.

Figure 1:
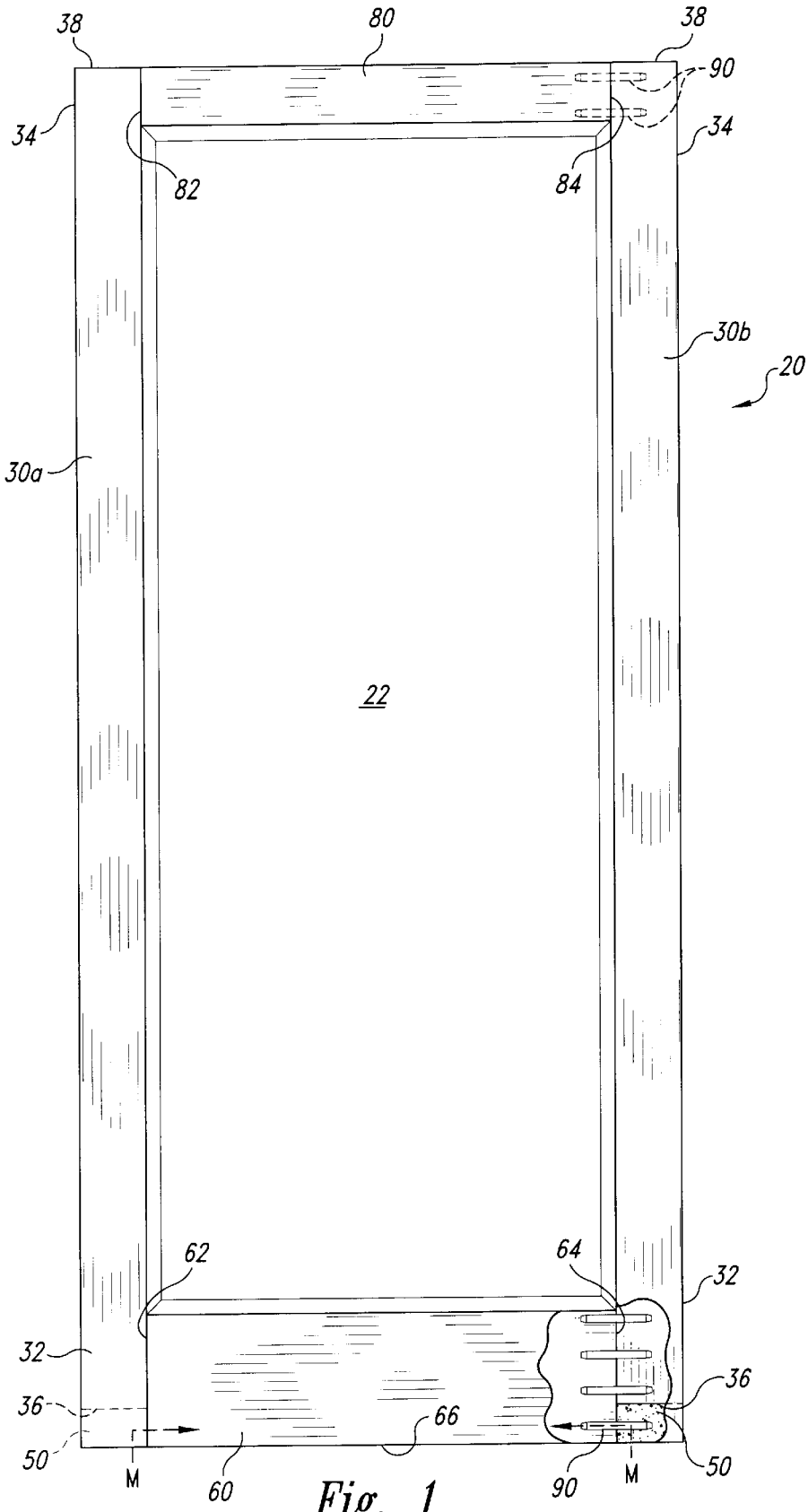
FIG. 1 is a front elevation view of a door in accordance with an embodiment of the invention.

FIG. 1 is a front elevation view of a moisture-resistant door 20 including first and second wood stiles 30 (respectively identified by reference numbers 30*a* and 30*b* in FIG. 1), a bottom rail 60 attached to one portion of each stile 30, and a top rail 80 attached to another portion of each stile 30. The bottom rail 60 can have a first end 62 attached to a lower region 32 of the first stile 30*a* and a second end 64 attached to a lower region 32 of the second stile 30*b*. The top rail can have a first end 82 attached to an upper region 34 of the first stile 30*a* and a second end 84 attached to an upper region 34 of the second stile 30*b*. In this particular embodiment, the door 20 includes and end-cap assembly having a first moisture resistant end-cap 50 attached to the first stile 30*a* and a second moisture-resistant end-cap 50 attached to the second stile 30*b*. A panel or window 22 is preferably mounted in the interior region between the stiles 30. As explained in greater detail below, the moisture-resistant end-caps 50 inhibit moisture from entering the stiles 30 and the bottom rail 60.

Figure 2:
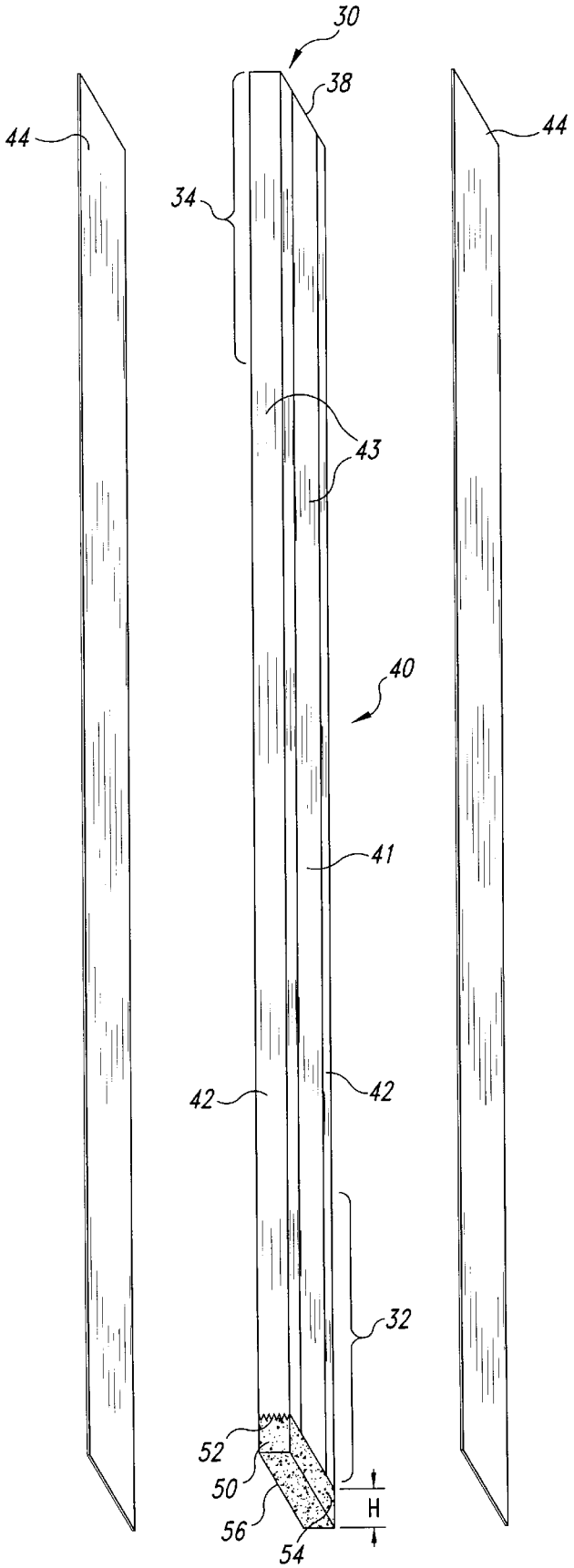
FIG. 2 is an exploded isometric view of an embodiment of a rail and end-cap assembly in accordance with an embodiment of the invention.

FIG. 2 is an exploded isometric view of one embodiment of a stile and end-cap assembly. In this embodiment, the wood stile 30 has a wood core assembly 40 including a center core 41 and finished wood edge pieces 42 attached to opposing sides of the center core 41. The center core 41 is typically a lesser expensive wood, and the finished edge pieces 42 are generally high quality or exotic woods. Because the center core 41 and the edge pieces 42 are wood, they have longitudinal vesicles 43 extending in the direction of the wood grain. The stile 30 can also have a core assembly 40 cut from a single piece of wood without the finished edge pieces 42. The stile 30 has a lower end 36 at the lower region 32 and an upper end 38 at the upper region 34. The lower and upper ends 36 and 38 of each stile 30 are accordingly open-grain ends cut transversely with respect to the longitudinal vesicles 43.

The end-cap 50 is attached to the lower end 36 of the stile 30. In the embodiment shown in FIG. 2, the end-cap 50 is attached to the stile 30 by a finger joint 52 and an adhesive composed of polyvinyl acetate (PVA). The end-cap 50 can also be attached to the stile 30 using a tongue and groove joint, a dovetail joint, a butt joint, or other suitable joints for mechanically bonding the end-cap 50 to the stile 30. Additionally, the adhesive may be a polyurethane adhesive or another suitable adhesive.

The end-cap 50 can be an extruded block or strip of a composite material including small wood particles (e.g., a wood flour) suspended in a polymeric matrix. The polymeric material, for example, can be a polyethylene or a polyolefin. One suitable wood/polymer composite includes approximately 30%–60% wood particles by weight and approximately 40%–70% polymeric material by weight. The end-cap can also be composed of other materials that have low moisture absorption or complete moisture-resistant characteristics, expansion and contraction characteristics similar to wood, and can be glued to wood, painted, stained and/or machined. Suitable extruded wood/polymeric composites are manufactured by Crane Plastics Co. of Columbus, Ohio under their TimberTech™ product line. The end-cap 50, for example, can also be a block or strip of another type of moisture-resistant material, such as a polymeric material without wood.

The end-cap 50 in the embodiment of the door 20 shown in FIGS. 1 and 2 has a height "H" of approximately 1.0–3.0 inches, and preferably of approximately 2.50–2.75 inches. The height H of the end-cap 50 is generally selected to provide enough moisture-resistant material at the bottom ends 36 of the stiles 30 so that the bottom of the door 20 can be trimmed to fit a particular door frame. In a typical application, it may be necessary to trim up to 2.0 inches from the bottom of the door 20. The end-cap 50 accordingly should have a length of at least approximately 2.5 inches to maintain 0.5 inches of moisture-resistant material on a fully-trimmed door. The end-cap 50 of this embodiment, however, should not have a height more than 3.0 inches because the wood/polymer composite material is generally much heavier and more expensive than wood.

After the end-cap 50 is attached to the core assembly 40, the end-cap 50 and the core assembly 40 are planed so that a front side surface 54 and a back side surface 56 of the end-cap 50 are flush with the front and back side surfaces of the core assembly 40. A plurality of individual veneer panels 44 are then attached to the front and back sides of the core assembly 40 and the end-cap 50. In a typical application, the veneer panels 44 are adhered to the core assembly 40 and the end-cap 50 with an adhesive, such as PVA or other suitable adhesives.

When the end-caps 50 are composed of wood/polymer composites or other polymeric materials, the front and back side surfaces 54 and 56 of the end-cap 50 are preferably treated to enhance the bond between the adhesive and the end-cap 50. In one embodiment, the front side surface 54 and the back side surface 56 of the end-cap 50 are prepared using an electrical surface treatment in which an air-blown arc plasma engages these surfaces. The electrical energy from the arc plasma increases the surface tension of the polymeric matrix material so that the front side surface 54 and the back side surface 56 of the end-cap 50 have better wetting characteristics for the adhesive. The adhesive accordingly bonds well with the treated surfaces. Suitable electrical surface treatment equipment for generating an air-blown arc plasma are manufactured by TanTec Company of Schaumburg, Ill. The front side and back side surfaces 54 and 56 can also be heat treated with a flame or other suitable treatments to increase the surface tension of the end-caps 50. After the front and back side surfaces 54 and 56 of the end-cap 50 have been treated, the veneer panels 44 are adhered to the core assembly 40 and the end-cap 50. In one embodiment, the veneer panels are adhered to the core 40 and the end-cap 50 using a Type I catalyzed polyvinyl acetate adhesive cured at 265° F. for 2–3 minutes under a force of 100 psig.

Figure 3:
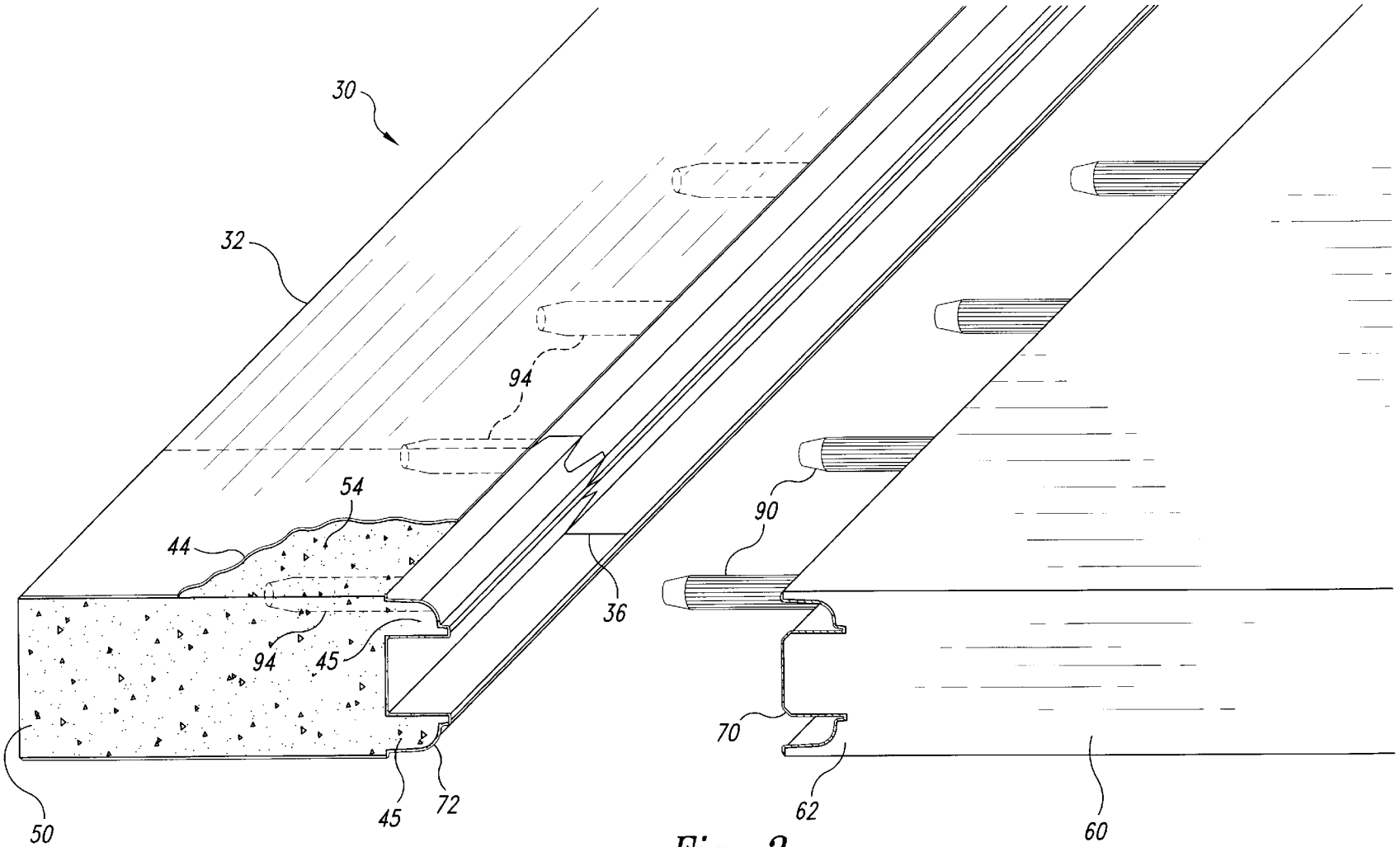
FIG. 3 is a partial isometric view of a portion of a door in accordance with an embodiment of the invention.

FIG. 3 is a partial exploded isometric view of the joint between the first end 62 of the bottom rail 60 and both the wood stile 30 and the end-cap 50. In this embodiment, a sealant layer 70 is applied to the profiled surface of the first end 62. The sealant layer 70 can be a cured adhesive layer or another type of hardened moisture-resistant material. For example, the sealant layer 70 can be sprayed onto the second end 62 of the bottom rail 60 and then cured to form a hardened sealant layer 70. The sealant layer 70 can also be brushed or rolled onto the second end 62 of the bottom rail 60. The sealant layer 70 is preferably thin enough to follow the contoured profile of the second end 62 without interfering with the fit between the second end 62 and a contoured sticking region 45 along an interior edge of the stile 30 and the end-cap 50. To allow the particular profile of the sticking region 45 to mate with the particular first end 62 of the bottom stile 60 shown in FIG. 3, the sealant layer 70 is preferably between 0.005 and 0.020 inches thick, and more preferably from approximately 0.008 to 0.014 inches thick. In one particular embodiment, the sealant layer 70 is a polyvinyl acetate layer that is sprayed to a thickness of approximately 0.008 to 0.014 inches thick and then cured in a heat chamber at an elevated temperature for a period of time.

After the sealant layer 70 has hardened, the bottom rail 60 can be attached to the stile 30 and the end-cap 50 using a plurality of dowels 90 and a separate adhesive layer 72 covering the sticking region 45. The adhesive layer 72 can be an uncured adhesive applied to the sticking region 45 in addition to the sealant layer 70 applied to the ends of the bottom rail 60. The adhesive 72 is also preferably spread into the dowel holes 94. For example, the adhesive 72 can be applied in beads along the sticking region 45 and in the dowel holes 94. The adhesive can alternatively be sprayed to completely cover the sticking region 45 and/or the surface in the dowel holes 94. The dowels 90 are then inserted into the dowel holes 94 and the sticking region 45 is engaged with the second end 62 of the bottom rail 60. The dowels 90 and the adhesive layer 72 accordingly hold the bottom rail 60 to both the stile 30 and the end-cap 50.

This embodiment of the door 20 inhibits or prevents moisture damage to the stiles 30 and the bottom rail 60. Referring to FIG. 1, a conventional door without the end-caps 50 is subject to water damage because moisture flows along a travel path "M" from the open-grain bottom end of a wood stile through the dowels and into the bottom rail. One aspect of this particular embodiment is that the inventors discovered that only a minimal amount of moisture enters the lower rail 60 through a bottom surface 66 of the rail 60. The end-caps 50 alone can thus substantially inhibit or prevent moisture from entering both the open-grain lower ends 36 of the stiles 30 and the open-grain ends 62 and 64 of the bottom rail 60. The bottom rail 60 can accordingly be composed solely of wood because the end-caps 50 and the bottom surface 66 of the bottom rail protect the bottom rail 60 from moisture. Thus, by blocking the moisture from entering the open-grain ends of the stiles 30, the embodiment of the wood door 20 shown in FIGS. 1–3 is expected to be less subject to moisture damage compared to wood doors without the end-caps 50.

The embodiment of the wood door 20 is also expected to further inhibit or prevent moisture damage of the bottom rail 60 because the first and second ends 62 and 64 of the bottom rail 60 can be sealed with a cured layer of sealant. In contrast to conventional wood doors that use only a single layer of uncured adhesive to both seal and adhere the bottom rail to the stiles, the embodiment of the wood door 20 also has a layer 70 of cured sealant or adhesive applied to the open-grain ends 62 and 64 of the bottom rail 60. By curing the sealant layer 70 on the open-grain ends 62 and 64 of the bottom rail 60, the sealant layer 70 provides a moisture barrier to prevent moisture from entering the bottom rail 60 through the open-grain ends 62 and 64. The separate sealant layer 70 accordingly further inhibits or prevents moisture damage to the bottom rail 60 of this particular embodiment of the door 20. It will be appreciated, however, that the separate sealant layer 70 may not be necessary in all applications.

Figure 4:
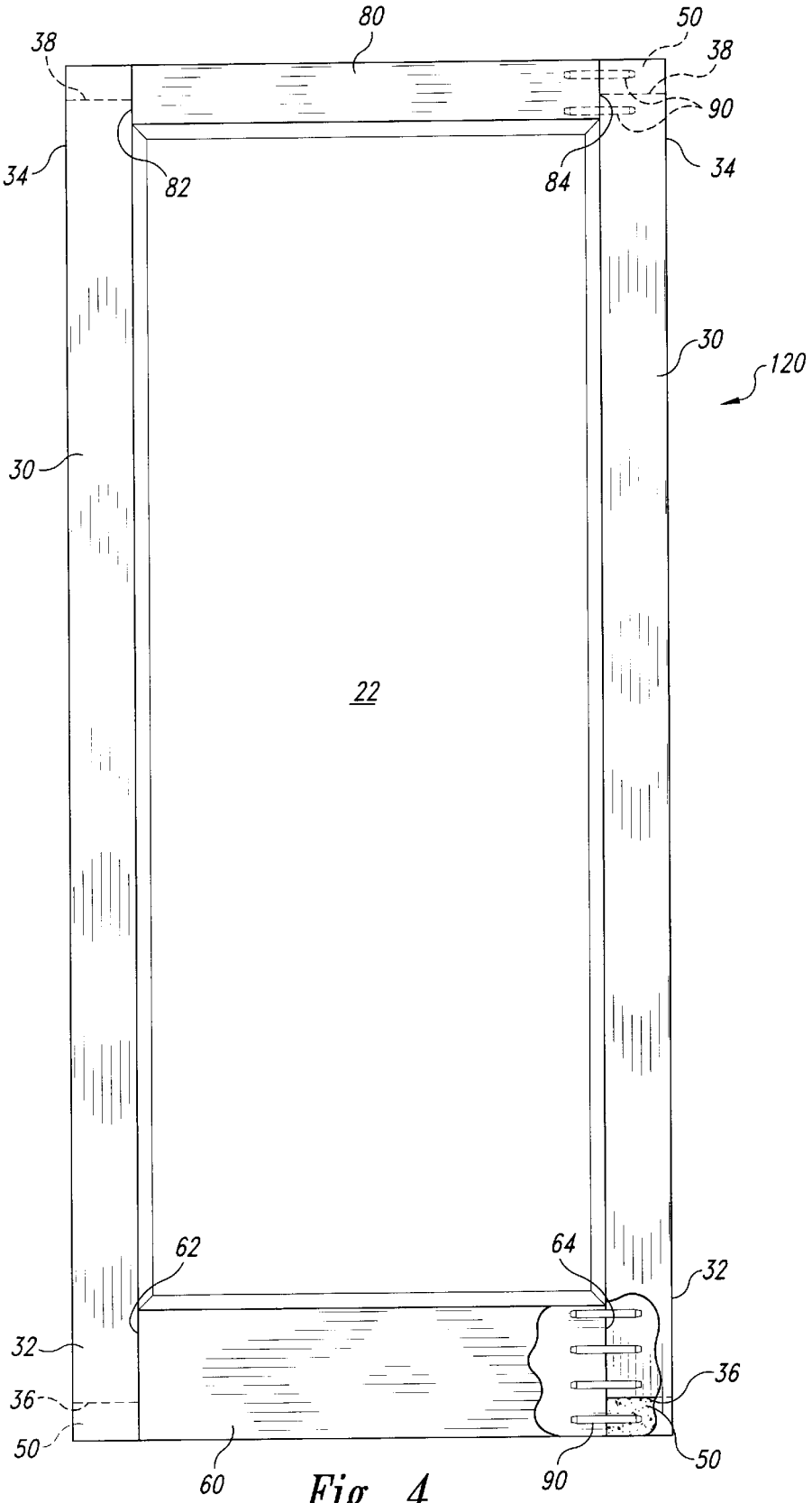
FIG. 4 is a front elevation view of another door in accordance with another embodiment of the invention.

FIG. 4 is a front elevation view of a door 120 in accordance with another embodiment of the invention. The door 120 is similar to the door 20, and thus like reference numbers refer to like components in FIGS. 1–4. The door 120 further includes an end-cap 50 attached to the upper open-grained end 38 of each stile 30. The door 120 is accordingly particularly well-suited for structures that have no overhangs or limited overhangs to protect the top of the door 120. The end-caps 50 attached to the upper ends 38 of the stiles 30 may be the same as the end-caps 50 discussed above with reference to FIGS. 1–3. Therefore, the upper end-caps 50 are preferably finger jointed to the stiles 30 and surface treated with an electrical surface treatment.

Figure 5:
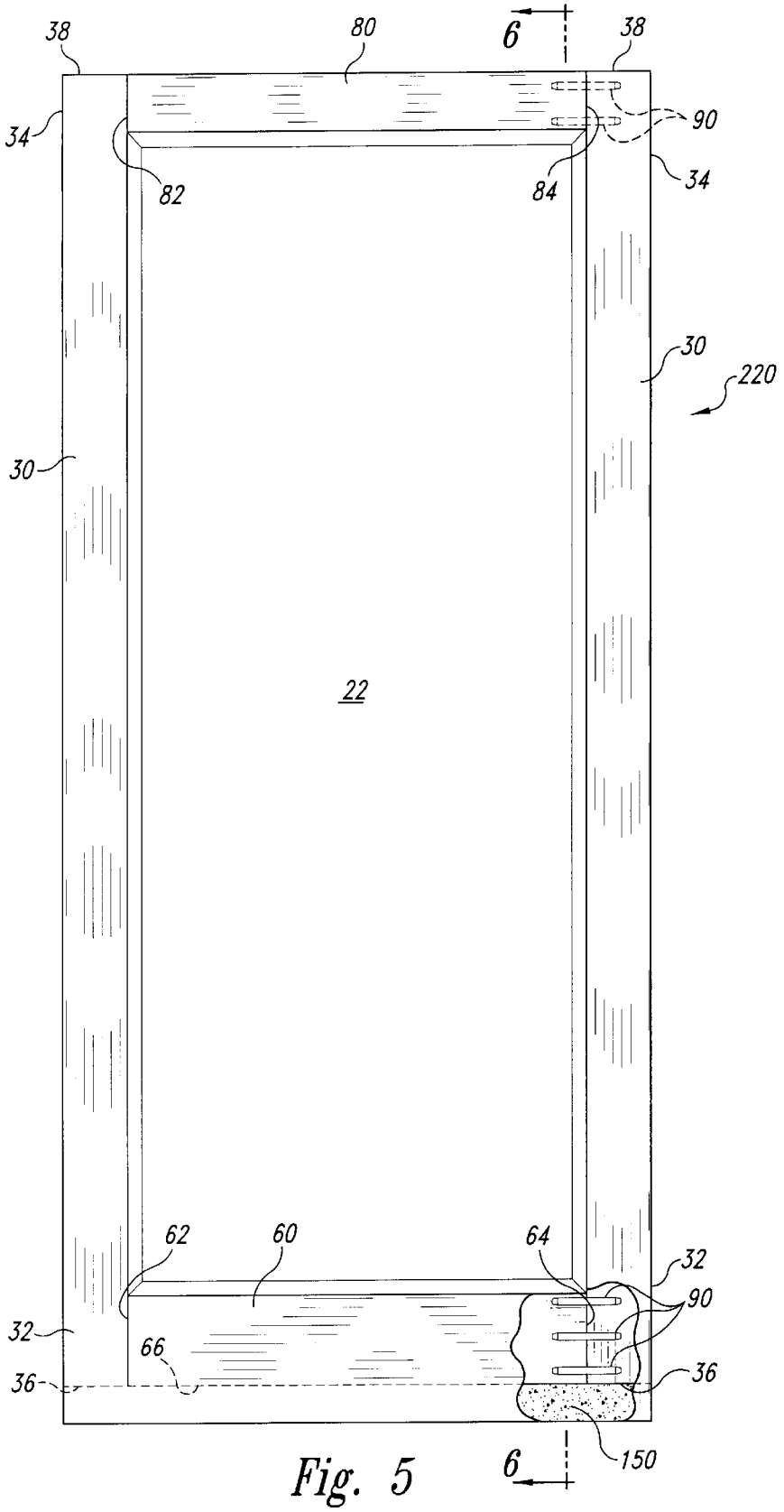
FIG. 5 is a front elevation view of yet another door in accordance with yet another embodiment of the invention.
Figure 6:
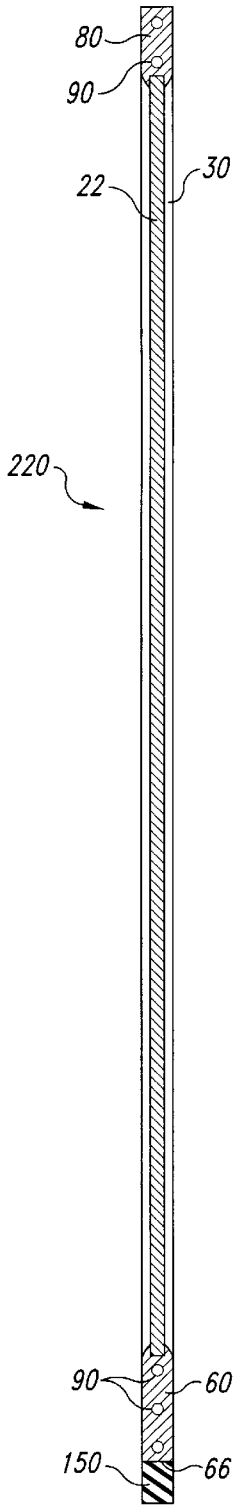
FIG. 6 is a cross-section view of the door of FIG. 5 taken along line 6—6.

FIG. 5 is a front elevation view and FIG. 6 is a cross-section view of a door 220 in accordance with yet another embodiment of the invention. The door 220 includes a single end-cap 150 attached to the lower end 36 of each stile 30 and the bottom surface 66 of the bottom rail 60. The end-cap 150 is preferably attached to the stiles 30 and the bottom rail 60 by a finger joint and an adhesive. The end-cap 150 can be composed of a wood/polymer composite or another suitable water resistant material.

Figure 7:
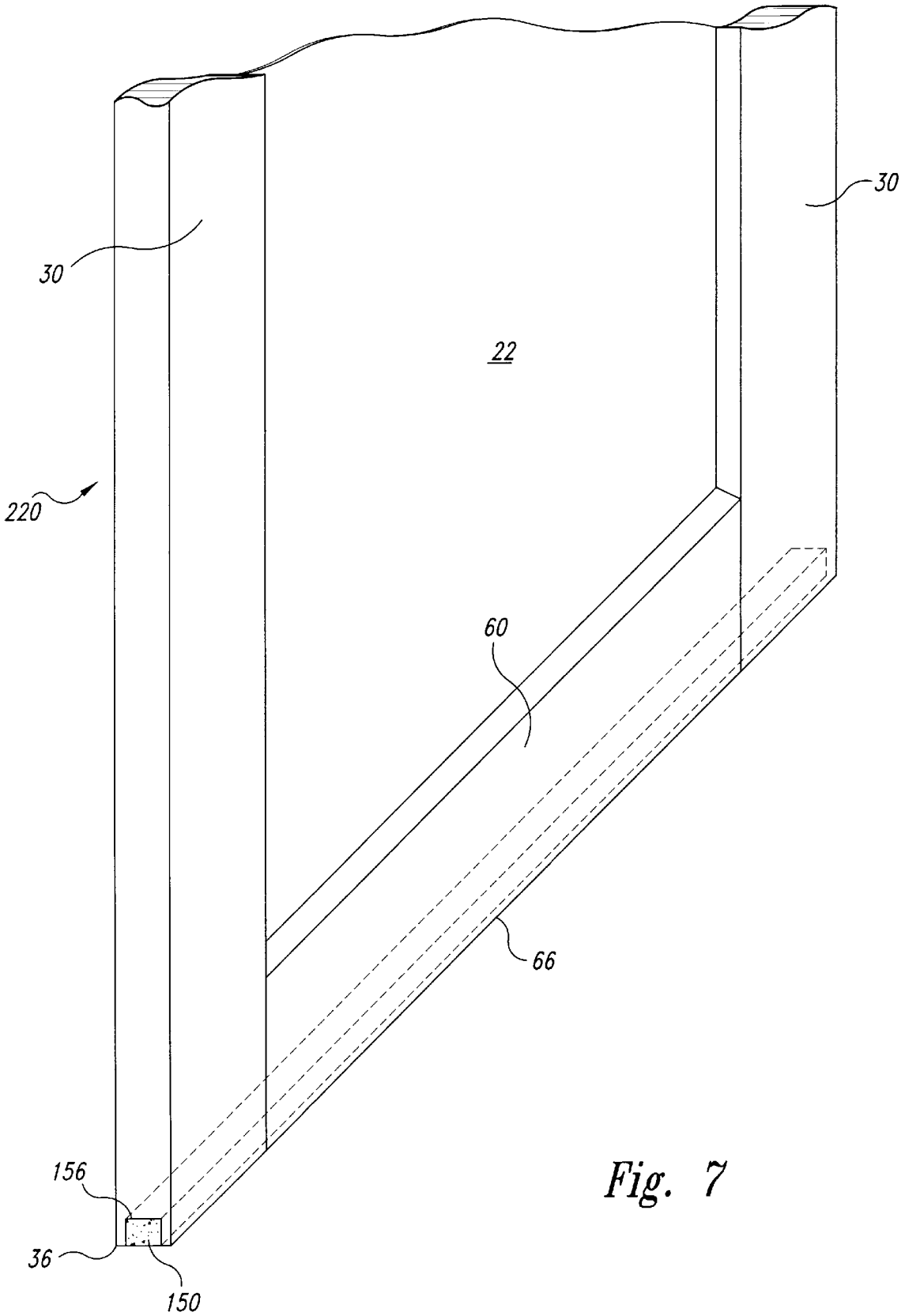
FIG. 7 is a partial isometric view of another embodiment of the door of FIG. 5.

FIG. 7 is a partial isometric view of another embodiment of the door 220 having a bottom end-cap 150 inserted into a channel 156 extending through the lower end 36 of each stile 30 and the bottom surface 66 of the bottom rail 60. This particular embodiment of the door 220 is expected to be an improvement over conventional exterior wood doors, but it may be subject to some water damage because moisture may enter the exposed portions of the lower ends 36 of the stiles 30.

Figure 8:
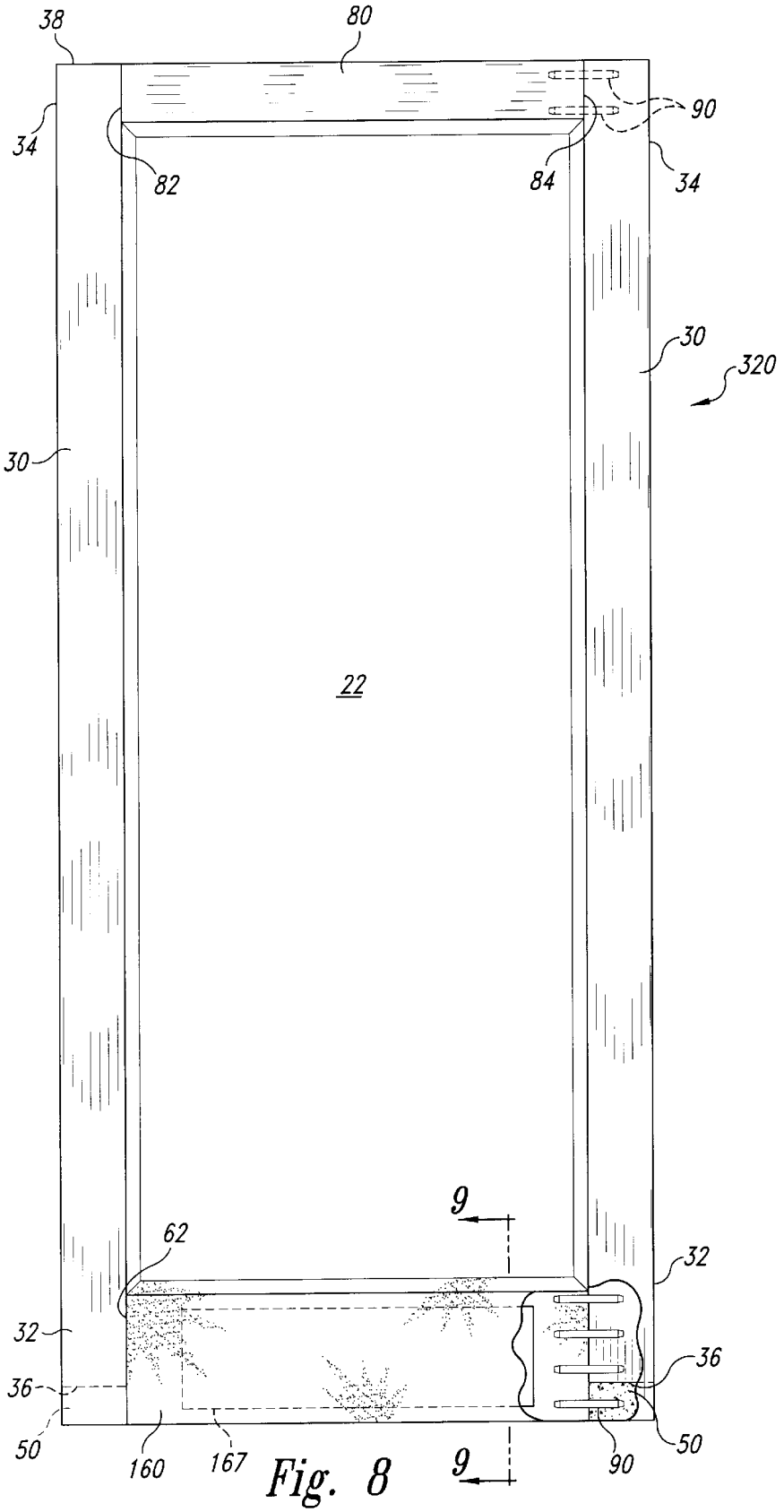
FIG. 8 is a front elevation view of still another door in accordance with still another embodiment of the invention.
Figure 9:
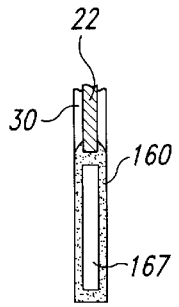
FIG. 9 is a partial cross-section view of the door of FIG. 8 taken along line 9—9.

FIG. 8 is a front elevation view and FIG. 9 is a partial cross-section view of a door 320 in accordance with another embodiment of the invention. In this embodiment, an end-cap 50 is attached to the lower end 36 of each stile 30, and the bottom rail 160 is composed of a moisture-resistant material. The bottom rail 160, for example, can be composed of the wood/polymer composite described above with respect to the end-caps 50 of FIGS. 1–3. Because wood/polymer composites are generally dense, heavy materials, the bottom rail 160 may have a cavity 167 (FIG. 9) to reduce the weight of the bottom rail 160.

Figure 10:
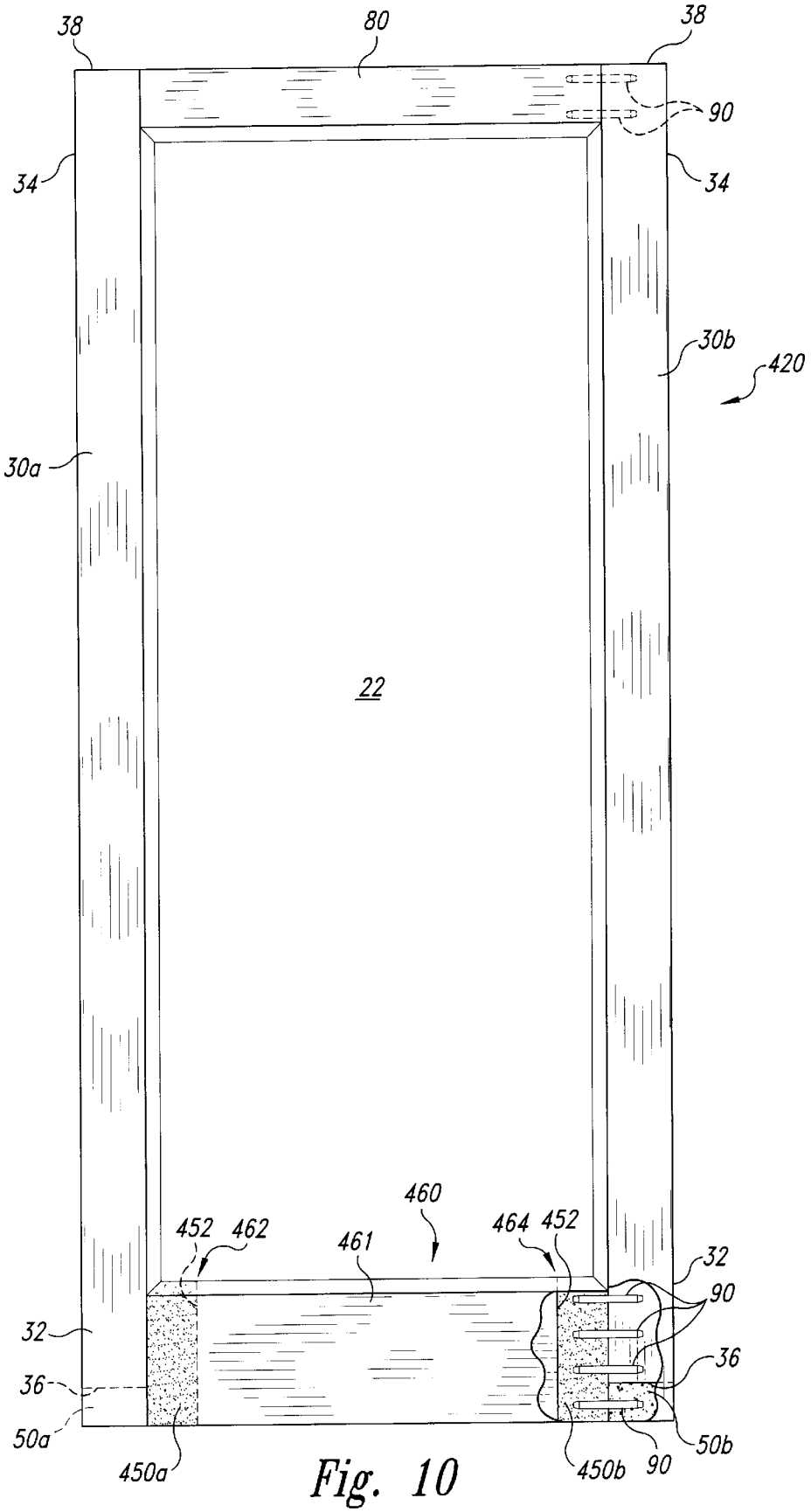
FIG. 10 is a front elevation view of another door in accordance with another embodiment of the invention.

FIG. 10 is a front elevation view of a door 420 in accordance with still another embodiment of the invention. In this embodiment, the door 420 includes a first moisture-resistant end-cap 50*a* attached to the lower end 36 of the first rail 30*a* and a second moisture-resistant end-cap 50*b* attached to the lower end 36 of the second rail 30*b*. The door 420 further includes a bottom rail 460 having a wood section 461, a third moisture-resistant end-cap 450*a* attached to a first open-grain end 462 of the wood section 461, and a fourth moisture-resistant end-cap 450*b* attached to a second open-grain end 464 of the wood section 461. The third and fourth end-caps 450*a* and 450*b* are preferably attached to the wood section 461 by a finger joint 452. The door 420 accordingly prevents moisture from entering the open-grain ends of the stiles 30 and the bottom rail 160 with separate end-caps. The bottom rail 460 can accordingly be attached to the stiles 30 without a separate sealant layer applied to the open-grain ends of the bottom rail in the manner set forth above with respect to the bottom rail 60 described in FIGS. 1–3.

Although specific embodiments of the invention have been described above for purposes of illustration and enablement, various modifications may be made to the embodiments and features described herein without deviating from the spirit and scope of the invention. The foregoing is accordingly not intended to be exhaustive or to limit the invention. For example, the invention can also apply to doors having multiple divided windows and panels. Aspects of the invention can also be achieved using other moisture resistant materials, such as fiber-cement composites.

Moreover, features of the foregoing embodiments can be combined with other features and aspects of wood doors. Accordingly, the invention is not limited except as set forth in the appended claims.

What is claimed is:

1. An exterior wood door comprising:

a first wood stile including a first upper region having a first upper end and a first lower region having a first lower end;

a second wood stile including a second upper region having a second upper end and a second lower region having a second lower end; each of the stiles having a front side and a back side;

a top rail having a first end attached to the first upper region of the first stile and a second end attached to the second upper region of the second stile;

a first moisture-resistant end-cap attached to and covering the entire first lower end of the first stile and a second moisture-resistant end-cap attached to and covering the entire second lower end of the second stile; and a bottom rail having a first end attached to the first lower region of the first stile, including the end-cap, with a moisture-resistant sealant and adhesive and a second end attached to the second lower region of the second stile, including the end-cap, with a moisture-resistant sealant and adhesive.

2. The door of claim 1 wherein:

the first moisture-resistant end-cap being a composite of wood and a polymeric material, and the first moisture-resistant end-cap having a length in the direction of the length of the first stile of at least approximately 1.0 inch;

the second moisture-resistant end-cap being a composite of wood and a polymeric material, and the second moisture-resistant end-cap having a length in the direction of the length of the second stile of at least approximately 1.0 inch;

a veneer covering a front side and a back side of each of the first wood stile, the second wood stile, and the first and second moisture-resistant end-caps.

3. The door of claim 1 wherein the end-cap comprises an extruded block of a composite including wood and a polymeric material.

4. The door of claim 1 wherein:

the first moisture-resistant end-cap is attached to the lower end of the first stile, the first moisture-resistant end-cap comprising a composite of wood and a polymeric material; and the door further comprises a second moisture-resistant end-cap attached to the lower end of the second stile, the second moisture-resistant end-cap comprising a composite of wood and a polymeric material.

5. The door of claim 4 wherein the bottom rail comprises:

a wood section having a plurality of longitudinal vesicles, a first open-grain end, and a second open-grain end, the first and second open-grain ends being cut transversely to the vesicles of bottom rail;

a third moisture-resistant end-cap attached to the first open-grain end of the bottom rail and the first lower region of the first stile; and a fourth moisture-resistant end-cap attached to the second open-grain end of the bottom rail and the second lower region of the second stile.

6. The door of claim 1 wherein the moisture-resistant sealant and adhesive comprises an uncured film of polyvinyl acetate.

7. The door of claim 1 wherein:

the first moisture-resistant end-cap is attached to the lower end of the first stile, the first moisture-resistant end-cap comprising a composite of wood and a polymeric material;

the door further comprises a second moisture-resistant end-cap attached to the lower end of the second stile, the second moisture-resistant end-cap comprising a composite of wood and a polymeric material; and the bottom rail comprises a composite block including wood and a polymeric material, the composite block of the bottom rail extending from the first lower region of the first stile to the second lower region of the second stile.

8. A door comprising:

a first wood stile including a first upper region having a first upper end and a first lower region having a first lower end;

a second wood stile including a second upper region having a second upper end and a second lower region having a second lower end;

a top rail having a first end attached to the first upper region of the first stile and a second end attached to the second upper region of the second stile;

a bottom rail having a first end attached to the first lower region of the first stile and a second end attached to the second lower region of the second stile; and at least a first moisture-resistant end-cap attached to at least one of the first lower end of the first stile and the second lower end of the second stile, wherein:

the first moisture-resistant end-cap is attached to the lower end of the first stile, the first moisture-resistant end-cap comprising a composite of wood and a polymeric material;

the door further comprises a second moisture-resistant end-cap attached to the lower end of the second stile, the second moisture-resistant end-cap comprising a composite of wood and a polymeric material;

the bottom rail having a first end covered with a first hardened moisture-resistant layer and a second end covered with a second hardened moisture-resistant layer, the first end of the bottom rail being attached to the first lower region of the first stile by a first adhesive layer separate from the first moisture-resistant layer covering the first end, and the second end of the bottom rail being attached to the lower region of the second stile by a second adhesive layer separate from the second moisture-resistant layer covering the second end; and the door further comprising a plurality of dowels, at least a first plurality of the dowels extending through the first and second lower regions of the first and second stiles and through the first or second ends of the bottom rail, at least one dowel extending through the first end-cap and the first end of the bottom rail, and at least one dowel extending through the second end-cap and the second end of the bottom rail, wherein the dowels are sealed with a layer of sealant completely coating holes in which the dowels are inserted.

9. An exterior moisture-resistant wood door comprising:

a first wood stile including a first upper region having a first upper end and a first lower region having a first lower end;

a second wood stile including a second upper region having a second upper end and a second lower region having a second lower end;

a top rail having a first end attached to the first upper region of the first stile and a second end attached to the second upper region of the second stile;

at least first and second moisture-resistant end-caps attached to and covering the entire first lower end of the first stile and the second lower end of the second stile, respectively; and a bottom rail composed solely of wood, the bottom rail having a first end attached to the first lower region of the first stile, including the end-cap, with a moisture-resistant sealant and adhesive; a second end attached to the second lower region of the second stile, including the end-cap, with a moisture-resistant sealant and adhesive and a plurality of longitudinal vesicles extending between the first and second ends.

10. The door of claim 9 wherein:

the first and second moisture-resistant end-caps comprising a composite of wood and a polymeric material.

11. The door of claim 9 wherein:

the first moisture-resistant end-cap comprising a composite of wood and a polymeric material;

the second moisture-resistant end-cap comprising a composite of wood and a polymeric material; and the sealant and adhesive is in two separate layers, one layer being a first hardened moisture-resistant sealant layer and the second layer being a first adhesive layer separate from the first moisture-resistant sealant layer.

12. The door of claim 9 wherein the sealant and adhesive comprises a film of cured polyvinyl acetate having a thickness from approximately 0.005 to 0.020 inch.

13. The door of claim 12 wherein the first and second adhesive layers comprise a film of polyurethane adhesive.

14. The door of claim 9 wherein:

the door further comprises a veneer covering a front side and a back side of each of the first wood stile, the second wood stile, and the first and second moisture-resistant end-caps.

15. An exterior moisture-resistant wood door, comprising:

a first wood stile including a first upper region having a first upper end and a first lower region having a first lower end;

a second wood stile including a second upper region having a second upper end and a second lower region having a second lower end;

a top rail having a first end attached to the first upper region of the first stile and a second end attached to the second upper region of the second stile;

a bottom rail having a first end attached to the first lower region of the first stile and a second end attached to the second lower region of the second stile;

first and second moisture-resistant end-caps attached to and covering the entire lower ends of the first lower end of the first stile and the second lower end of the second stile, respectively;

the ends of the rails being attached to the stiles including attached to the moisture-resistant end-caps by an adhesive sealant; and a veneer covering the first wood stile, the second wood stile and the moisture-resistant end-caps.

16. A door comprising:

a first wood stile including a first upper region having a first upper end and a first lower region having a first lower end;

a second wood stile including a second upper region having a second upper end and a second lower region having a second lower end;

a top rail having a first end attached to the first upper region of the first stile and a second end attached to the second upper region of the second stile;

a bottom rail having a first end attached to the first lower region of the first stile and a second end attached to the second lower region of the second stile; and at least a first moisture-resistant end-cap attached to at least one of the first lower end of the first stile and the second lower end of the second stile, wherein:

the first moisture-resistant end-cap is attached to the lower end of the first stile, the first moisture-resistant end-cap comprising a composite of wood and a polymeric material;

the door further comprises a second moisture-resistant end-cap attached to the lower end of the second stile, the second moisture-resistant end-cap comprising a composite of wood and a polymeric material;

the bottom rail having a first end covered with a moisture-resistant layer of sealant and adhesive layer, the first end of the bottom rail being attached to the first lower region of the first stile by said layer of sealant and adhesive, and the second end of the bottom rail being attached to the lower region of the second stile by a second sealant and adhesive layer;

the door further comprising a plurality of dowels, at least a first plurality of the dowels extending through the first and second lower regions of the first and second stiles and through the first or second ends of the bottom rail, at least one dowel extending through the first end-cap and the first end of the bottom rail, and at least one dowel extending through the second end-cap and the second end of the bottom rail, wherein the dowels are sealed with a layer of sealant and adhesive completely coating holes in which the dowels are inserted.

17. The door of claim 7 wherein the composite block of the bottom rail has an interior cavity.

* * * * *